United States Patent [19]

Classon et al.

[11] Patent Number: 4,780,095

[45] Date of Patent: Oct. 25, 1988

[54] EDGE CONNECTOR FOR CIRCUIT BOARDS

[75] Inventors: Edwin O. Classon, Berlin, Mass.; Colin C. Gordon, Palo Alto, Calif.; Frank S. Gregory, New Boston, N.H.; George R. Kitzman, Nashua, N.H.; R. Clifford Lupien, Winchendon, Mass.; William C. Mooney, Kinburn; Michael T. Singer, Kanata, both of Canada

[73] Assignee: Digital Equipment Corporation, Maynard, Mass.

[21] Appl. No.: 26,735

[22] Filed: Mar. 17, 1987

[51] Int. Cl.[4] ..... H01R 13/04

[52] U.S. Cl. ..... 439/637

[58] Field of Search ..... 439/59, 60, 62, 629, 439/630, 633, 634, 636, 637

[56] References Cited

U.S. PATENT DOCUMENTS

| | | | |
|---|---|---|---|
| 3,475,657 | 10/1969 | Knowles | 439/62 |
| 4,262,981 | 4/1981 | Goodman | 439/62 |
| 4,439,000 | 3/1984 | Kaufman et al. | 439/62 |
| 4,556,268 | 12/1985 | Neschese | 339/74 R |
| 4,576,427 | 3/1986 | Verbruggen | 339/61 |
| 4,586,772 | 5/1986 | Cobaugh | 439/629 |

*Primary Examiner*—Joseph H. McGlynn

*Attorney, Agent, or Firm*—Cesari and McKenna

[57] ABSTRACT

An edge connector for electrically connecting and mechanically securing a daughter board to a mother board. The edge connector includes an insulator body with a pair of stalks spaced apart so as to accomodate a daughter board therebetween. The insulator body is provided with a number of contacts, each of which is housed inside a contact slot inside the insulator body. Each contact has a surface pressure contact area for electrically connecting to the mother board to which the edge connector is attached. Each contact also has a contact area that extends into the daughter board slot. The contacts are arranged so that in each pair of adjacent contacts one contact has an upper contact area and the other a lower contact area. The upper contact areas are located above the lower contact areas. This makes it possible to use a daughter board with two rows of offset contact pads with this edge connector.

13 Claims, 2 Drawing Sheets

EDGE CONNECTOR FOR CIRCUIT BOARDS

FIELD OF THE INVENTION

This invention relates to electro-mechanical connectors for circuit boards, and more particularly to edge connectors that mechanically secure and electrically connect the edge portions of circuit boards.

BACKGROUND OF THE INVENTION

Electrical connectors are designed to provide conductive paths between adjacent printed circuit boards. Some connectors also mechanically seize the boards to which they are connected so as to physically secure one board to the adjacent board. Connectors of this type are often installed on a primary, or "mother" board, and are adapted to receive the edges of secondary, or "daughter" boards. These connectors are called edge connectors and are used in modern electrical eguipment that contains a number of parallel daughter boards that are closely packed together.

Edge connectors often comprise a number of conductive contacts that are spaced apart and arranged linearly in a housing. Each contact is metallic, and is positioned to abut a conductive contact pad on the edge of the daughter board. Often the contacts are arranged in two parallel rows so the daughter board can be inserted therebetween. When a daughter board is positioned between the rows, the contacts exert a gripping force on the daughter board so as to secure it in the housing.

There are a number of disadvantages to the edge connectors currently in use. The conductors of most of these connectors have vertical stems that must be solder-connected to plated through holes in the mother board. Providing the mother board with a large number of plated through holes consumes a significant area on the board and reguires that conductors and other circuit components on the board be designed around them. Moreover, it is difficult to change the edge connectors on a board since they are semi-permanently attached to the board.

In addition, the mechanism many edge connectors use to secure the daughter boards is inefficient. Some edge connectors rely on Zero Insertion Force, (ZIF) mechanisms. The contacts of these connectors are in registration with a cam rod so that at least one of the parallel rows of contact connectors can be selectively moved towards or away from the opposite row. Initially, the contacts are spaced apart from each other. After the daughter board is inserted between the opposed rows of contacts, the rows are moved together so as to grip the daughter board therebetween. ZIF connectors rely on relatively expensive mechanical mechanisms to secure the daughter boards. Furthermore, the securing mechanism is formed of a number of moveable parts, any of which may malfunction because of either wear or breakage.

Other edge connectors rely on Low Insertion Force, (LIF) contacts. These contacts are pieces that have been stamped and bent to have a shape with spring-like resiliant characteristics. Eventually though, the contacts lose their resiliency and are deformed into a permanently open shape. When a daughter board is placed between the worn contacts they do not firmly abut the daughter board. As a result, they no longer secure the daughter board to the housing, nor do they make a reliable electrical connection with the daughter board's contact pads.

Moreover, only a limited number of electrical connections can be made per unit length of the daughter board. This is because the individual contact pads on the daughter board have to have a minimum width to insure that there is a sufficient area of contact between them and the conector contacts to form a continuous electrical path with minimal resistance. Also, the contact pads must be spaced apart a sufficient distance so that under normal operation conditions adjacent pads will not short circuit. Current contact pads have a cross-sectional width of 80 mils (0.080") and are spaced apart approximately 20 mils. Thus, each contact pad and insulating gap occupies 100 mils of length, so a maximum of 10 contacts per inch of daughter board can be accommodated. The increasing miniaturization of electronic circuits requires that more connections per unit length of board be made available.

Furthermore, some edge connectors provide only signal contacts to the daughter board. They are not suited to transfer the power needed to operate components that may be located on the daughter boards.

SUMMARY OF THE INVENTION

A principle object of this invention therefore is to provide an edge connector with contacts that do not have to be permanently or semi-permanently attached to the mother board. Thus, mounting of this connector on the mother board does not require the extensive relocation of other components and conductors around it. A further object of this invention is to provide a connector with contacts that are able to secure the daughter board. Furthermore, the contacts are able to withstand the stress of repeated insertion and removal of daughter boards without becoming worn. Moreover, the contacts are arranged to provide a large number of electrical connections per unit length along the daughter boards. Still another object of this invention is to provide an edge connector able to transfer both signal and power currents to and from the daughter board.

These and other objects of this invention are provided by an edge connector comprising a insulator module containing two parallel rows of spaced-apart, flexible contacts. Each contact is paired with a contact located directly across from it. A board slot is defined by a space in the module between the rows of contacts. Each contact includes a contact area that extends into the board slot space. The contacts are arranged so that in each row, the contact areas of adjacent contacts are longitudinally offset from each other. More specifically, for each pair of adjacent contacts one has a upper contact area, and the other a lower contact area, wherein the upper contact area is spaced above the lower contact area. The contacts are also arranged so that a contact with an upper contact area is located directly across from a contact with a lower contact area. Thus, one row of contacts includes contact areas arranged in a upper-lower-upper-lower pattern, and the opposite row includes contact areas arranged in a lower-upper-lower-upper pattern. Each contact is urged away from the board slot by a pre-load barrier, integral with the module, that is located above the contact.

The edge connector module can be supplied with both thin-profile signal contacts and wide-profile power contacts. The signal contacts are formed from blanking out of flat stock. Both types of contacts are provided with surface pressure contacts that abut contact pads on the mother board the edge connector is attached to.

The edge connector is used by first mounting it on the mother board. The surface pressure contacts impinge on mother board contact pads so as to form an electrical path therebetween. A daughter board is then fastened to the edge connector by inserting its edge into the board slot. The resilient properties of the contacts cause their contact areas to press against the daughter board. The daughter board is thus secured between the two rows of contacts pressing against it. Furthermore, the contact area of each contact impinges upon a separate contact pad on the daughter board so as to form an electrical path therebetween. Thus, each contact serves as a conductive link that connects a daughter board contact pad to a complementary contact pad on the mother board.

There are a number of advantages to this edge connector. Since in each row the contact areas of adjacent contacts are offset, the contact pads on the daughter boards can similarly be offset. Thus, it is possible to provide each side of the daughter board with two rows of contact pads. This doubles the number of electrical connections available per unit length of daughter board without reducing the required tolerences between the contact pads or without reducing the size of the contact pads.

Also, the signal contacts are each relatively resilient. This is in part because the contacts are profiled out of flat stock rather than pressed into shape like traditional contacts. As a result the contacts are not prone to become bent out of shape with the subsequently loss of resiliency. Furthermore, the pre-load barriers insure the contacts exert sufficeint normal force against the daughter board with only a minimal amount of displacement. This insures the long term flexibility of the contacts since they are not stretched out of their normal range of elasticity.

Furthermore, providing the surface pressure contacts eliminates the need to provide plated through holes on the mother board. This simplifies the need to design the mother board circuitry around the edge connector. This also makes it unnecessary to attach the contacts by soldering or other semi-permanent means, making it simpler to remove and replace the edge connector.

Also, the contacts of this invention are side loaded into the module. This means the normal force exerted by the contacts on the insulator module is a function of the contacts' position relative to the module. Thus, the normal force the contacts exert can be easily adjusted by inserting the contacts in a different module.

Other advantages of this invention will become obvious as a preferred embodiment of the invention is described.

DETAILED DESCRIPTION OF THE DRAWINGS

DETAILED DESCRIPTION OF THE PREFERRED EMBODIMENT

Figure 1:
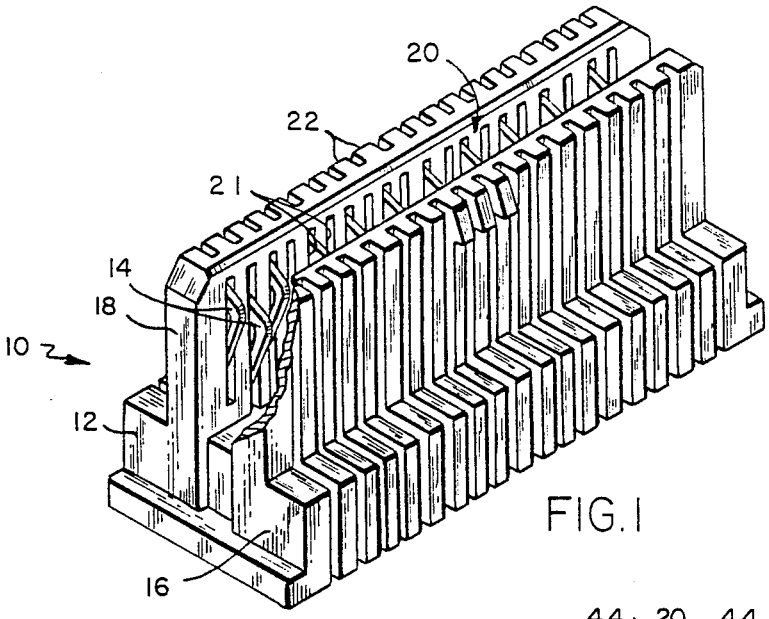
FIG. 1 is a perspective view of the basic edge connector module of this invention.
Figure 2:
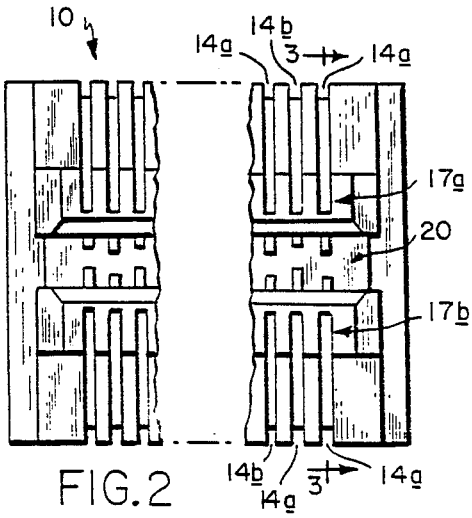
FIG. 2 is a partial top plan view of the basic edge connection module of this invention.

FIGS. 1 and 2 illustrate an edge connector module 10 comprising an insulator body 12 that contains a number of contacts 14*a* and 14*b*. The insulator body includes a base section 16 with a wide cross-sectional area and two symmetric, spaced apart stem sections 18 that extend up from the base and are spaced apart to form a board slot 20 therebetween. The contacts 14 are arranged in two rows 17*a*, 17*b* located on opposite sides of the board slot. Each contact is located in a contact slot 21 that are arranged in symmetric pairs across the board slot 20. Each contact slot is located in one half of the base section 16 and in the adjacent stem section 18. The contacts are loaded into the slots 21 through side openings 22 located along the body 12. The insulator body 12 also includes at least one alignment pin 23, (FIG. 3,) that projects downward from the base section 16.

The contacts 14 are arranged in the rows 17 so that upper contacts 14*a* alternate with lower contacts 14*b*. The upper contacts 14*a* each have an upper contact area 40*a* that extends into the board slot 20, and the lower contacts 14*b* each have a lower contact area 40*b* that also extends into the board slot. The upper contact areas 40*a* are all spaced above the lower contact areas 40*b*.

Figure 3:
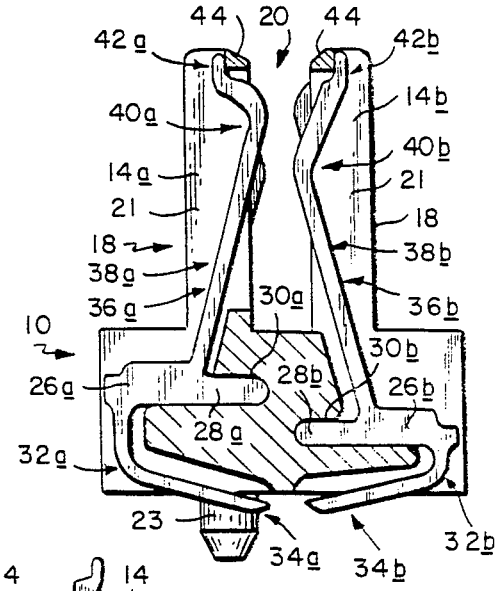
FIG. 3 is a cross-sectional of the basic edge connector module of this invention taken along line 3—3 in FIG. 2.

As is illustrated by FIGS. 2 and 3 the contacts are also arranged so that the upper contacts 14*a* and lower contacts 14*b* are each located directly across from each other along the board slot 20. Thus, the contacts in one row 17*a* are arranged in a upper-lower-upper-lower pattern, and the contacts in the opposite row 17*b* are arranged in a lower-upper-lower-upper pattern.

Referring still to FIG. 3 it can be seen that each contact 14 abuts one side of a solid center core 24 that is integral with the base section 16. Each contact 14*a*, 14*b* includes a stabilizer plate, 26*a* and 26*b* respectively, that has a bullet-nosed root section, 28*a* and 28*b* respectively, that is directed towards the opposite contact 14*b* or 14*a*. The root section is positioned within a slotted root nesting area, 30*a* and 30*b* respectively, in the center core 24 so as to secure the contact 14 within the insulator body 12. A surface pressure contact beam, 32*a* and 32*b* respectively, extends downward from each stabilizer plate 26*a*, 26*b* distal from the root section 28*a*, 28*b*, curves under the insulator body center core, and terminates adjacent to the longitudinal center line of the insulator body. A surface pressure contact 34*a* and 34*b* respesctively, is located at the end of each low beam for electrically connecting the contact to a contact pad on an adjacent mother board (not shown).

The contacts 14*a*, 14*b* each have a daughter board contact beam, 36*a* and 36*b* respectively, that extends upward from an intermediate location on the stabilizer plate 26*a*, 26*b*. Each daughter board contact beam 36*a*, 36*b* includes a stem, 38*a* and 38*b* respectively, that extends upward towards the board slot 20 from which the contact area 40*a* or 40*b* projects into the board slot 20. A restraining finger, 42*a* and 42*b* respectively, extends from each contact area 40*a*, 40*b* and is located in the contact slot 21. The restraining fingers each abut preload barriers 44 that are integral with the insulator body 12 and extend across the top of the contact slot 21 adjacent to the board slot 20.

The stabilizing plates 26a and 26b and complementary root nesting areas 30a and 30b are also offset from each other. Thus, the stabilizing plate 26a of the upper contact 14a and associated root nesting area 30a are located above the stabilizing plate 26b of lower contact 14b and associated root nesting area 30b.

Figure 4:
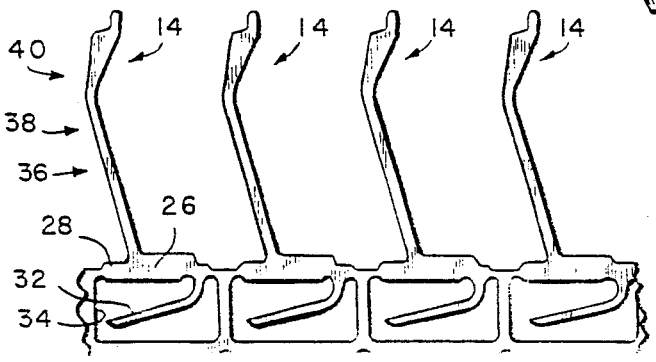
FIG. 4 is a view of a plurality of contacts of this invention blanked from flat stock.

As illustrated in FIG. 4 the contacts 14 may be profiled out of a section of flat stock 46. After the contacts are profiled they can be excised from the flat stock for insertion into the insulator body 12.

Figure 6:
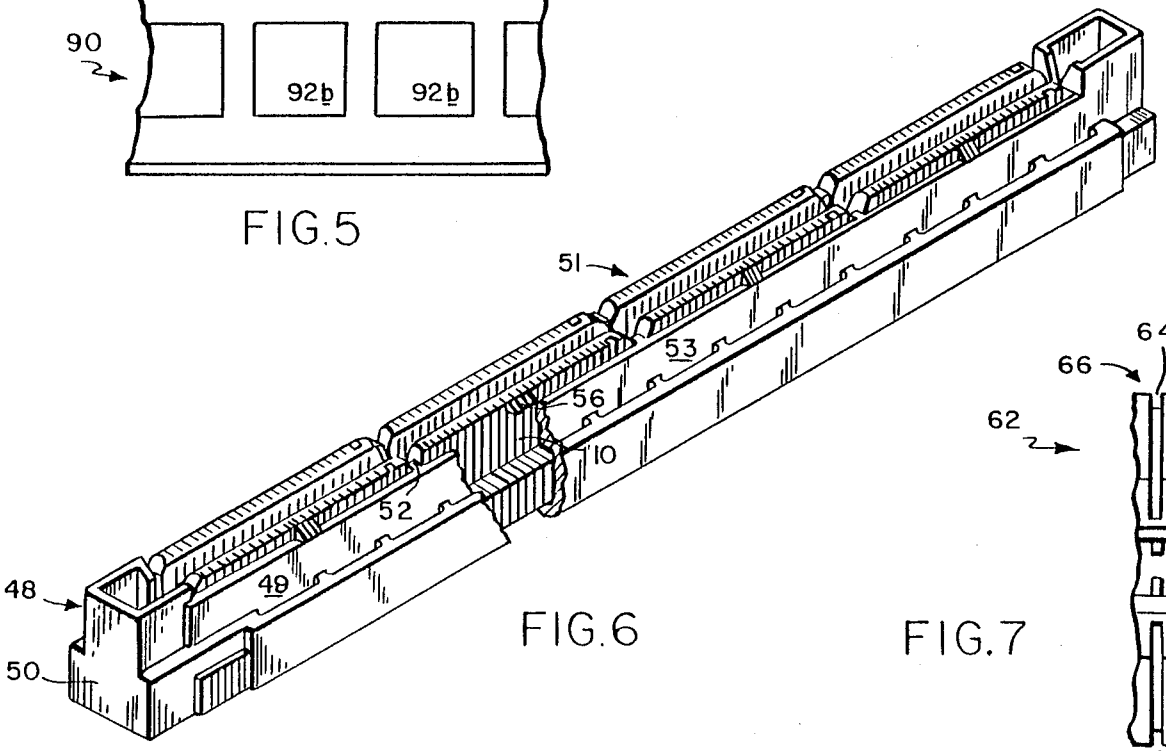
FIG. 6 is an exposed side view of an edge connector housing containing a number of edge connector modules.

FIG. 6 illustrates a plurality of longitudinally aligned edge connector modules 10 inside an edge connector housing 48. The housing is composed of plastic and formed from two elongated side walls 49 separated by end walls 50. The modules 10 are each located in a seating space 51 between the sidewalls. Each seating space is defined by the sidewalls and by either the end walls 50 or cross bars 52 that extend between the sidewalls 49. Top side walls 53 extend across the housing 48 adjacent to the lower portion of the body stem sections 18.

Lips 56 protrude from the top of the body stem sections 18 over the top surface of the top side walls 53. The lips secures the the modules 10 in the connector housing 48. The outer surfaces of the lips 56 are bevelled so the modules can be inserted into the connector housing.

The edge connector housing 48 with modules 10 attached is used by first installing the assembled unit on a mother board. The alignment pins 23 of the individual modules are positioned in separate bores (not shown) in the mother board so the edge connector surface pressure contacts 34 will abut the appropriate mother board contact pads. Since each module 10 has its own alignment pin 23, all of the contact surface pressure contacts areas 34 will be properly aligned, regardless of the number of modules there are.

Figure 5:
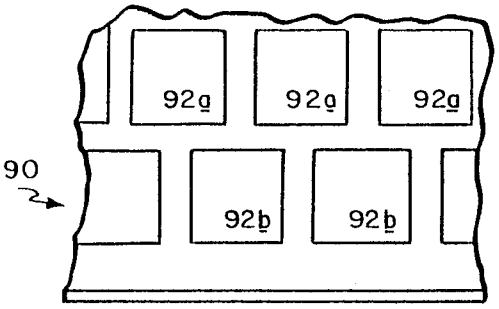
FIG. 5 is a side view of the terminal pads of a daughter board to be used with the edge connector of this invention.

A daughter board is coupled to the edge connector by inserting its edge section into the board slot 20 between the stems 18 of the insulator bodies 12. As shown in FIG. 5 a daughter board 90 used with the edge connector of this invention is provided with two rows of contact pads 92a, 92b that are offset from each other. The lower contact pads 92b are each under the gap that separates the upper contact pads 92a.

The daughter board 90 can be provided with offset rows of contact pads 92a and 92b since the contact areas 40a and 40b of the adjacent edge connector contacts 14 that they are designed to be in registration with are similarly offset. In other words, the upper contact areas 40a will abut the upper contact pads 92a and the lower contact areas 40b will abut the lower contact pads 90b. Thus, this edge connector makes it possible to double the number of contact pads available per unit length of the daughter board without decreasing the cross-sectional width of the contact pads or the spacing between them or the tolernce required to insure contact between the contact areas 40 and the contact pads 92.

Another advantage of this edge connector is that the stabilizer plate 26 does not transmit the forced deflectional movment of the daughter board contact beams 36 to the surface pressure contact beams 32. This is because the stabilizer plate is firmly secured in the body center core 24 by the root section 28. Thus, when a daughter board is inserted or removed from the edge connector, the motion of the forced deflection of the daughter board contact beam is blocked by the stabilizer plate. The surface pressure contact beam 32 does not move and the surface pressure contact 34 stays in electrical contact with the mother board contact pad it is in registration with.

Moreover the daughter contact beams 36 can be tapered since they are profiled from flat stock 46. The tapered structure produces a contact which is less prone to lose its resilantcy and flexibility. This significantly increases the useful lifetime of the contacts 14.

The preload barriers 44 also contribute to the utility of this edge connector. The preload barriers block the inward movement of the daughter board contact beams 36 towards the board slot 20. This reduces the stress the daughter board contacts exert on the insulator module so as to prevent it from becoming cracked over time. The preload barriers also limit the amount of displacement forced by the daughter boards 90 on the contacts 14 by pre-stressing them. Moreover, the preload barriers 44 limit the degree of laterial deformation individual daughter board contact beams 36 are subject to. This minimizes the need for contact pads 92 with wide cross-sectional widths to insure contact with the beam contacts 40. This also substantially eliminates the possibility that an indvidual daughter board contact beam 36 will become bent out of shape and not register with the approriate daughter board contact pad 92.

Furthermore, it is relatively simple to change the normal force the contacts 14 exert on a daughter board 90. This is because the normal force exerted by the contacts is a function of the depth of their insertion relative to the board slot 20. For example, an edge connector designed to provide minimal normal force would have contacts seated away from the board slot 20. An edge connector designed to have maximum normal force, on the other hand would have contacts seated close to the board slot. Also, it is relatively easy to load the contacts into the contact slots 21 through the inside openings 22 in the insulator body 12. This reduces the cost of manufacturing the edge connector.

Another advantages of this edge connector is that the contact surface pressure contacts 34 require only contact pads on the adjacent mother board. There is no need to provide plated through holes or to permanently connect the contacts to the mother board. Thus, there is no need to design large portions of the mother board's circuitry around areas dedicated to the edge connector contacts. Also the surface pressure mounting makes it relatively simple to repair or replace the edge connector modules.

Figure 7:
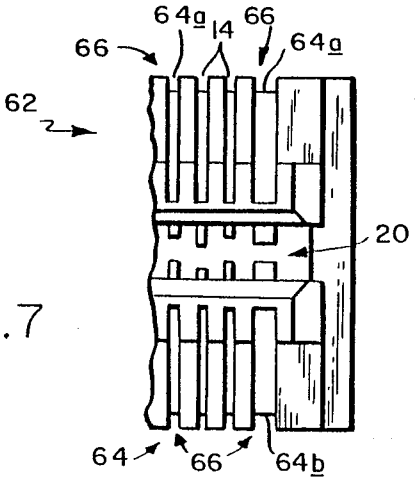
FIG. 7 is a top view of an edge connector of this invention containing both signal and power contacts.

Alternative combinations of contacts are possible with the edge connector of this invention. As illustrated in FIG. 7 a module 62 can be provided with both signal contacts 14 and power contacts 64. The power contacts have a cross-sectional area of approximately 0.75 mils$^2$ instead of the 0.28 mils$^2$ cross-sectional width of the signal contact. The module is provided with power contact slots 66 of increased width to accommodate the power contacts. The power contacts are also offset from each other so one contact 64a has an upper contact area and the opposite contact 64b has a lower contact area (contact areas not shown).

This embodiment of the invention makes it possible to supply a daughter board with both signal and power contacts from a single edge connector. It eliminates the need to have to supply the daughter board with power through separate low-resistance wires.

Furthermore in some embodiments of the invention it may be necessary to provide the edge connector housing 48 with clamping mechanisms (not illustrated) to secure a portion of the daughter board 90. This may be required when the daughter board is inserted horizontally into the edge connector or in other other situations where the contacts 14 alone do not have sufficent strength to hold the daughter board.

Thus it is understood that the following claims are intended to cover all the generic and specific features of the invention herein described.

What is claimed as new and desired to be secured by Letters Patent of the United States is:

1. An edge connector for mechanically securing and electrically connecting the edge of a circuit board, comprising:

(a) an insulator body having a base, and two parallel, spaced apart, symmetric stem sections extending upwards from the base located around the body center-line so as to form a board slot therebetween, and a plurality of laterally extending contact slots located along the length of the insulator body, each slot extending from one side of the base and through the adjacent stem, each slot located opposite an adjacent slot located across said board slot;

(b) a plurality of contacts, each contact located inside a separate contact slot, so as to form two rows of opposed contacts, each contact including a stabilizer plate secured inside the base of the insulator body, a surface pressure contact beam extending downward from the stabilizer plate with a surface pressure contact at the end of the surface pressure contact beam, a daughter board contact beam that extends upwards from the stabilizer plate into the board slot with a contact area inside the board slot, and a restraining finger above the contact area, and in at least one row, at least one upper contact, with an upper contact area, located adjacent to a lower contact, with a lower contact area, said upper contact area spaced above said lower contact area; and (c) a plurality of pre-load barriers, each pre-load barrier integral with the insulator body and extending across a contact slot adjacent to the daughter board slot so that the contact restraining finger abuts the pre-load barrier.

2. The edge connector of claim 1 further comprising:

(a) a center core within the base of the insulator body between the lateral opposed contacts, the center core incuding slotted root nesting areas adjacent the contact slots; and (b) a root section extending from said stabilizer plate of each of said contacts towards the insulator body center-line, and secured in one of said slotted root nesting areas.

3. The edge connector of claim 1 wherein the insulator body is provided with at least one alignment pin.

4. The edge connector of claim 1 wherein at least one pair of opposed contacts is profiled from flat stock.

5. The edge connector of claim 1 wherein at least one row contains all upper and lower contacts, and the contacts are arranged so that the upper contacts alternate with the lower contacts.

6. The edge connector of claim 1 wherein both rows contain the upper and lower contacts, and that in each row the contacts are arranged so that in each row the upper contacts alternate with the lower contacts and that along the board slot each upper contact is located opposite a lower contact and each lower contact is located opposite an upper contact

7. The edge connector of claim 6 wherein the stabilizer plate of said upper contacts are located above the stabilizer plate of said lower contacts

8. An edge connector comprising a housing containing at least one edge connector module adapted to receive a portion of a daughter board comprising:

A. a housing with elongated sidewalls spaced apart by end walls, the space between said sidewalls and said end walls defining at least one module seating areas; and B. at least one edge connector module positioned within one of said module seating areas, comprising;

(i) an insulator body having a base, and two parallel, spaced apart, symmetric stem sections extending upwards from the base located around the body center-line so as to form a board slot therebetween, and a plurality of laterally extending contact slots located along the length of the insulator body, each slot extending from one side of the base and through the adjacent stem, each slot located opposite an adjacent slot across the center line of the insulator body;

(ii) a plurality of contacts, each contact located inside a separate contact slot, so as to form two rows of opposed contacts, each contact including a stabilizer plate secured inside the base of the insulator body, a surface pressure contact beam extending downward form the stabilizer plate with a surface pressure contact area at the end of the surface pressure contact beam, a high beam that extends upwards from the stabilizer plate into the board slot with a contact area inside the board slot, and a restraining finger above the contact area, and in at least one row at least one upper contact, with an upper contact area, located adjacent to a lower contact, with a lower contact area, said upper contact area spaced above said lower contact area; and (iii) a plurality of pre-load barriers, each pre-load barrier integral with the insulator body and extending across a contact slot adjacent to the daughter board slot so that the contact restraining finger in the contact slot abuts the pre-load barrier.

9. The edge connector of claim 8 wherein said housing contains a plurality of longitudinally aligned module seating areas, at least two module seating areas separated by a cross bar extending between said sidewalls.

10. The edge connector of claim 8 wherein at least one pair of opposed contacts is profiled out of flat stock.

11. The edge connector of claim 8 wherein at least one row contains all upper and lower contacts, and the contacts are arranged so that the upper contacts alternate with the lower contacts.

12. The edge connector of claim 8 wherein both rows contain the upper and lower contacts, and that in each row the contacts are arranged so that in each row the upper contacts alternate with the lower contacts and that along the board slot each upper contact is located opposite a lower contact and each lower contact is located opposite an upper contact

13. The edge connector of claim 12 wherein the stabilizer plate of said upper contacts are located above the stabilizer plate of said lower contacts.

* * * * *